US006739939B2

(12) United States Patent
Matsukawa

(10) Patent No.: US 6,739,939 B2
(45) Date of Patent: May 25, 2004

(54) TOY TOP GAME UNIT

(75) Inventor: Hiroyuki Matsukawa, Tokyo (JP)

(73) Assignee: Takara Co., Ltd., Tokyo (JP)

( * ) Notice: Subject to any disclaimer, the term of this patent is extended or adjusted under 35 U.S.C. 154(b) by 0 days.

(21) Appl. No.: 10/136,724

(22) Filed: Apr. 30, 2002

(65) Prior Publication Data

US 2003/0064660 A1 Apr. 3, 2003

(30) Foreign Application Priority Data

Sep. 28, 2001 (JP) ..... 2001-300373

(51) Int. Cl.[7] ..... A63H 1/00

(52) U.S. Cl. ..... 446/256; 446/257; 446/259; 446/263

(58) Field of Search ..... 446/129, 259, 446/256, 257, 258, 260, 261, 262, 263, 264, 235, 236, 237, 238, 239, 133; 273/126 A, 443

(56) References Cited

U.S. PATENT DOCUMENTS 2,774,185 A * 12/1956 Kosch ..... 40/411
3,572,719 A * 3/1971 Span et al. ..... 273/139
3,783,550 A * 1/1974 Andrews ..... 446/484
4,043,558 A * 8/1977 Star ..... 273/110
4,200,283 A 4/1980 Andrews et al.
4,200,289 A * 4/1980 Bosley ..... 273/109
4,538,999 A * 9/1985 Orlowski ..... 446/259
4,630,822 A * 12/1986 Massaglia ..... 273/118 A
4,828,258 A * 5/1989 Gebert ..... 273/456
5,135,425 A * 8/1992 Andrews et al. ..... 446/133
5,518,437 A 5/1996 Nonaka et al.
6,150,913 A * 11/2000 Simmons ..... 335/306

FOREIGN PATENT DOCUMENTS

GB 2371496 7/2002
JP 9-155067 6/1997

OTHER PUBLICATIONS

Osawa, US 2002/0102907 A1, Aug. 1, 2002.*

* cited by examiner

*Primary Examiner*—Derris H. Banks
*Assistant Examiner*—Dmitry Suhol

(57) ABSTRACT

A toy top game unit is provided, the unit comprising a toy top, driving means for rotating said toy top, a game board for receiving said toy top thereon, means for interacting the toy top and the game with each other, and for imparting a change to an operational mode of the toy top on said game board.

The interacting means include first magnet means arranged on the toy top and second magnet means arranged on the game board.

3 Claims, 16 Drawing Sheets

TOY TOP GAME UNIT

BACKGROUND OF THE INVENTION

1. Field of the Invention

The present invention relates to a toy top game unit comprising a combination of a toy top and a game board, which allows spinning of the toy top thereon.

2. Description of the Related Art

Conventionally, toy tops have been very popular in the children's playgrounds, and children often play a game in which they strike their toy tops against those of their companions so as to drive out their companions' toy tops from the game board.

Now, for such a toy game, a variety of novel plans have been proposed and put in practice in the Art. For example, the toy top is constituted in such a manner that the toy top can be disassembled so that replacement of parts thereof may be carried out to vary spinning characteristics thereof, to thereby enhance the performance of the toy top so that it has the advantage in a competition. Particularly, it is desired that parts for the toy top be developed which add a function to a toy top that permits it to more strongly attack a competitors' toy top and more strongly defend against it.

However, the toy tops are spun and played on game boards and thus, even when the function of the toy tops are improved, since they move on game boards, the moving pattern thereof is dependent on the form of the game boards. For this reason, the game board disclosed in Japanese Utility Model Application No. 2001-385 has been proposed. This game board is provided thereon with a spinning plate, and this spinning plate is spun to change the performance characteristics of the toy tops, or a rebound plate is arranged on the game board, and by this rebound plate, the toy tops are rebounded so as to change the performance characteristics of the toy tops. However, it was not possible to change the performance characteristics of the toy tops unless the toy tops were definitely mounted on the spinning plate or the rebound plate.

SUMMARY OF THE INVENTION

It is an object of the present invention to solve the foregoing problem and provide a toy top game unit in which operational modes can be changed without the spinning toy tops being influenced by players directly or indirectly and by which the toy top game undergoes a new development.

In order to solve the foregoing problem, according to a first aspect of the present invention, there is provided a toy top game unit which comprises a toy top, driving means for rotating said toy top, a game board for receiving said toy top thereon, and means for interacting the toy top and the game board, and for imparting change to an operational mode of the toy top on said game board, said interacting means including first magnet means arranged on the toy top and second magnet means arranged on the game board.

According to a second aspect of the invention, there is provided a game board for playing a toy top game using a toy top having a magnet arranged thereon comprising a base board having an upper surface, and a game board mounted on said upper surface of said base board, said upper surface of said base board being provided with a receiving means for receiving said second magnet means therein, said game board being detachably mounted on said upper surface of said base board.

According to a third aspect of the invention, there is provided a toy top having a rotational axis thereof comprising a toy body having a shaft arranged at a lowermost portion thereof nd a mount support means for supporting a plurality of blade members thereon; said blade members being laid to overlap each other and being detachably mounted through said mount support means; and magnet means being arranged on the rotational axis of said toy top.

DETAILED DESCRIPTION OF THE PREFERRED EMBODIMENTS

Figure 1:
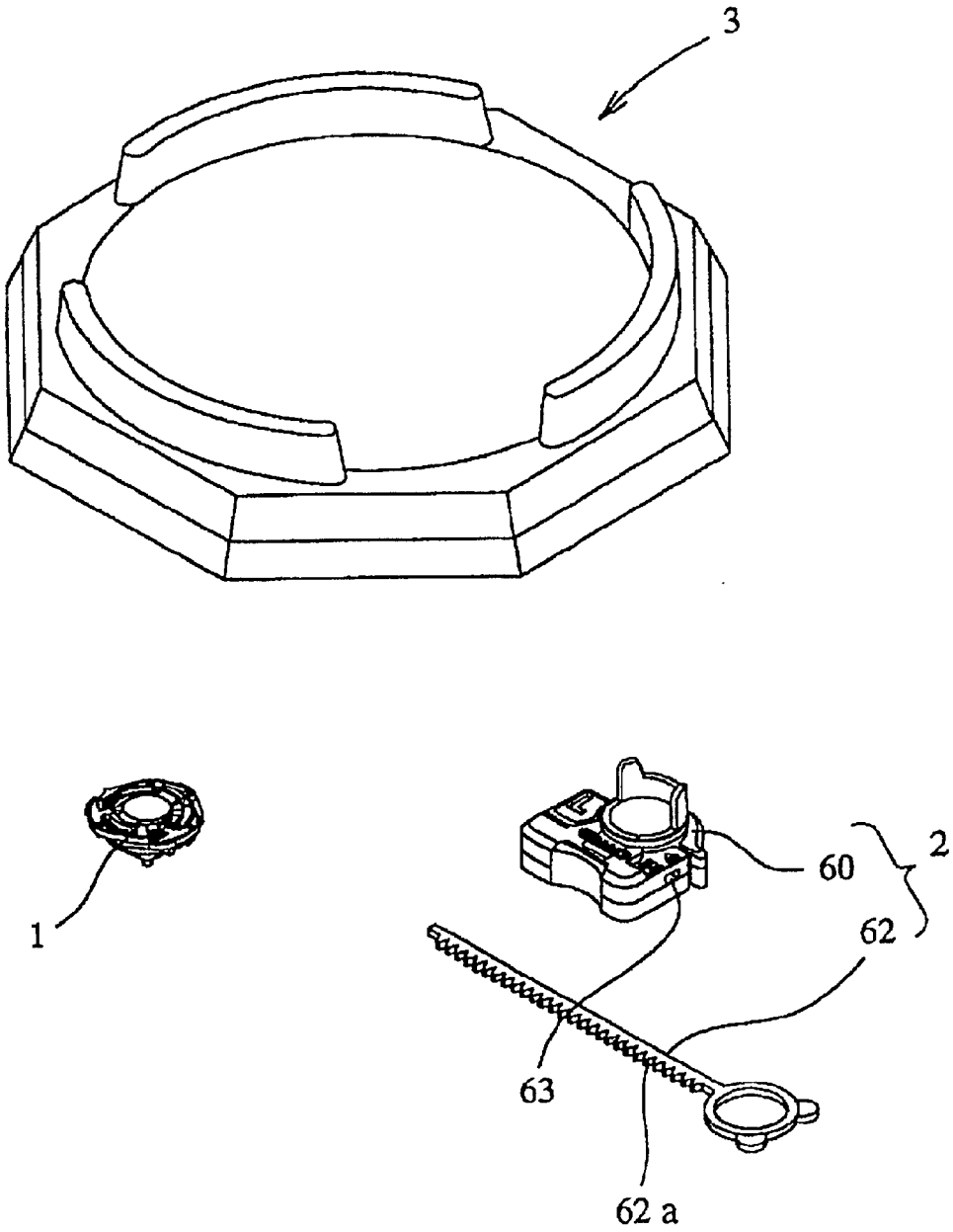
FIG. 1 is a perspective view showing one embodiment of a constitution of a toy top game unit according to the present invention.

FIG. 1 shows one embodiment of a toy top game unit according to the present invention. This toy top game unit is constituted by a toy top 1, driving means, i.e., a shooter 2 which spins the toy top 1 and a game board 3 where the toy top 1 is spun and competes with other toy tops 1 on the game board 3.

Figure 2:
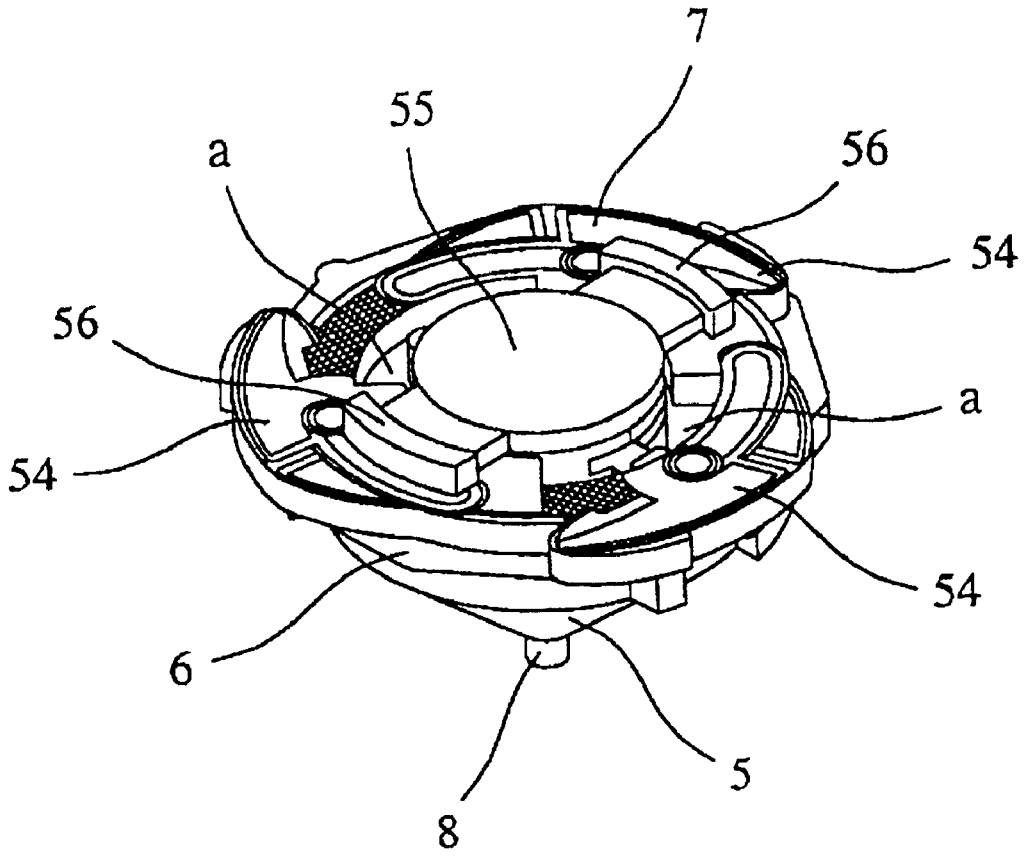
FIG. 2 is a perspective view of the toy top.

The toy top 1 is, as shown in FIG. 2, integrated with a base member 5 and a deadweight member 6 and an attack ring 7 are placed thereon.

Figure 3:
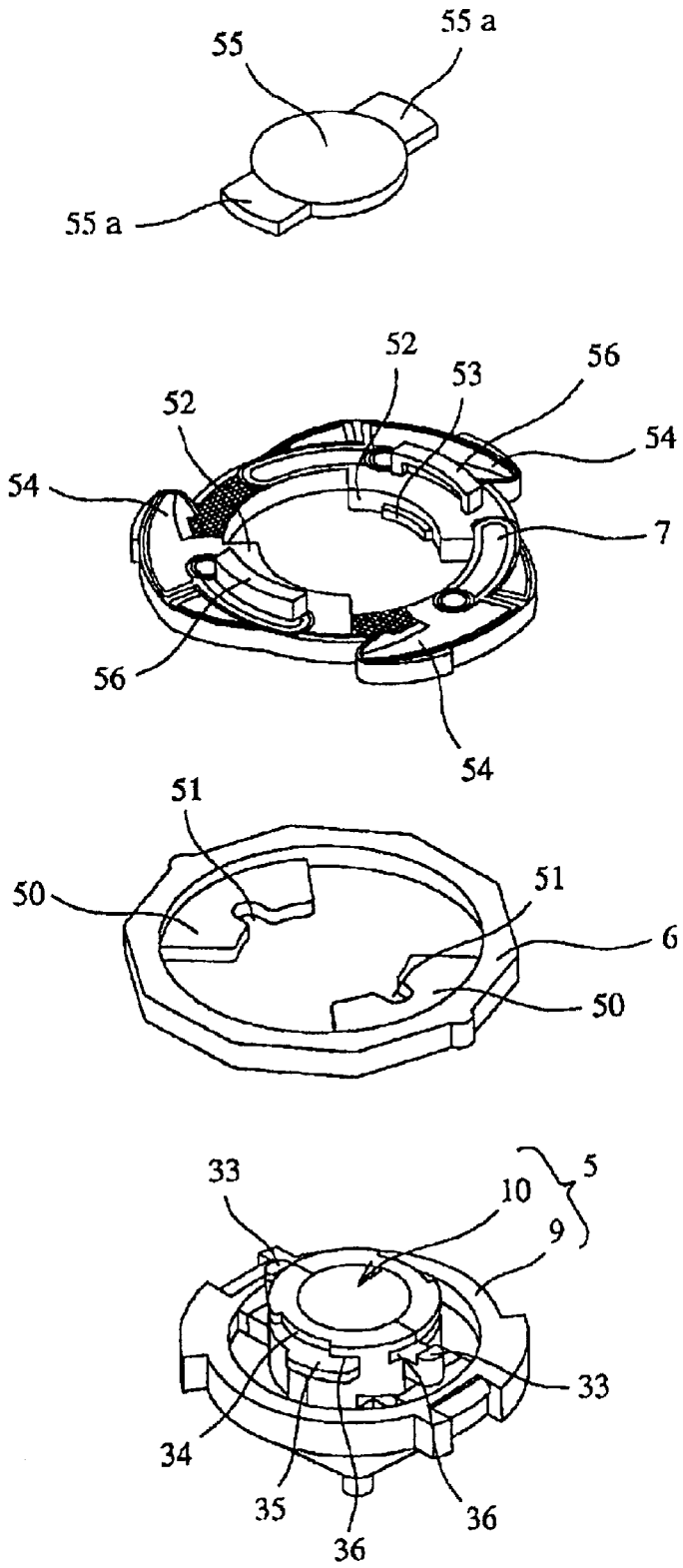
FIG. 3 is an exploded perspective view showing a structure of the toy top.
Figure 4:
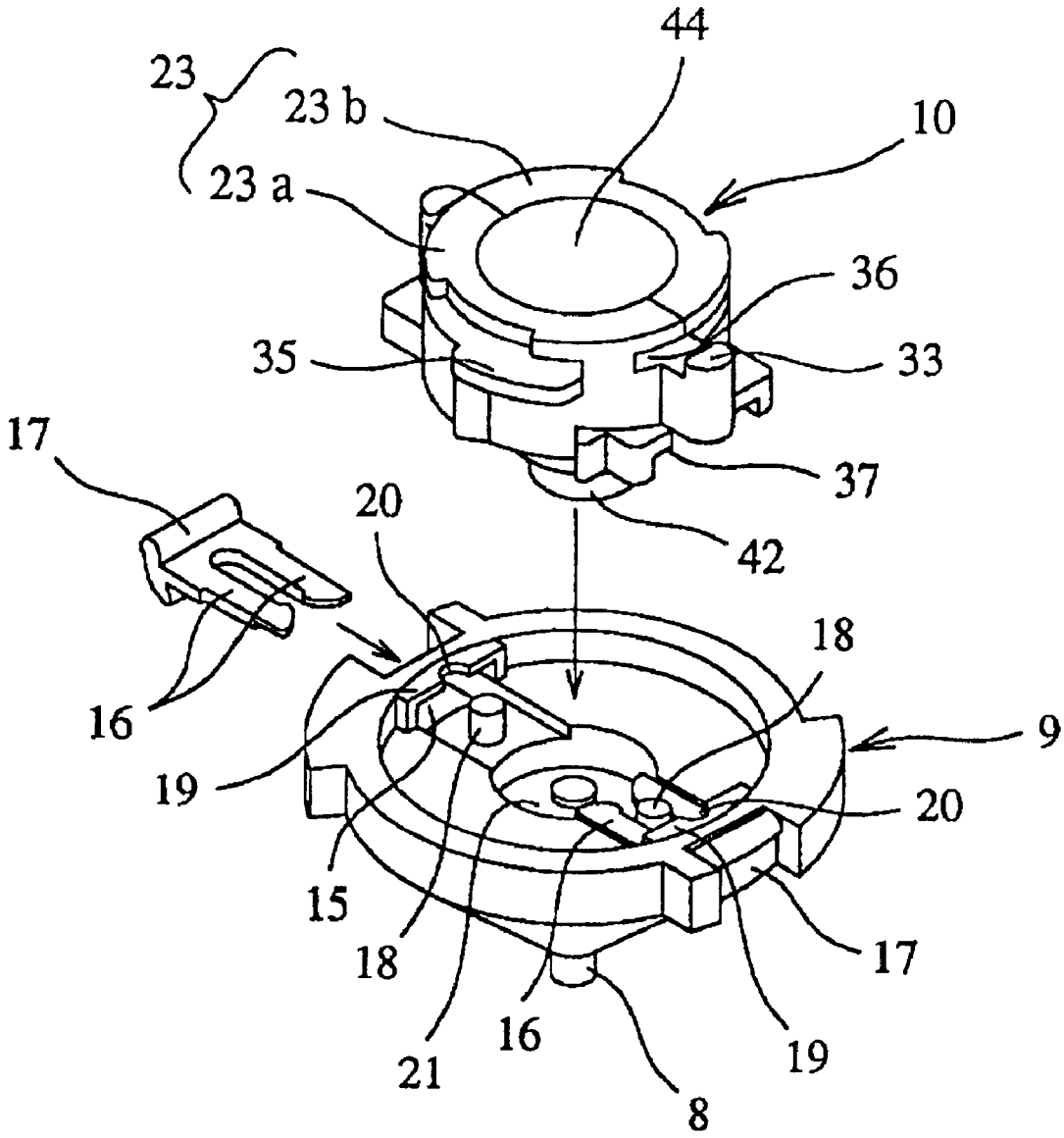
FIG. 4 is a perspective view showing a structure of a base member of the toy top.

The base member 5, as shown in FIGS. 3 and 4, is formed in an inverted cone shape and is comprised of a base member main body 9 which is formed with a core rod 8 protruded from the lower end, and an attachment base 10 which is attached to the upper surface center thereof.

An opening portion 15 which opens laterally is formed on both sides of the upper portion of the base member main body 9, and a fastener 17 having a pair of leg pieces 16 is detachably attached to the opening portion 15. Reference numeral 18 designates a protrusion which strides over the leg pieces 16, and a recessed groove 20 is formed on an upper leg piece 19 which constitutes the opening portion 15.

Figure 5:
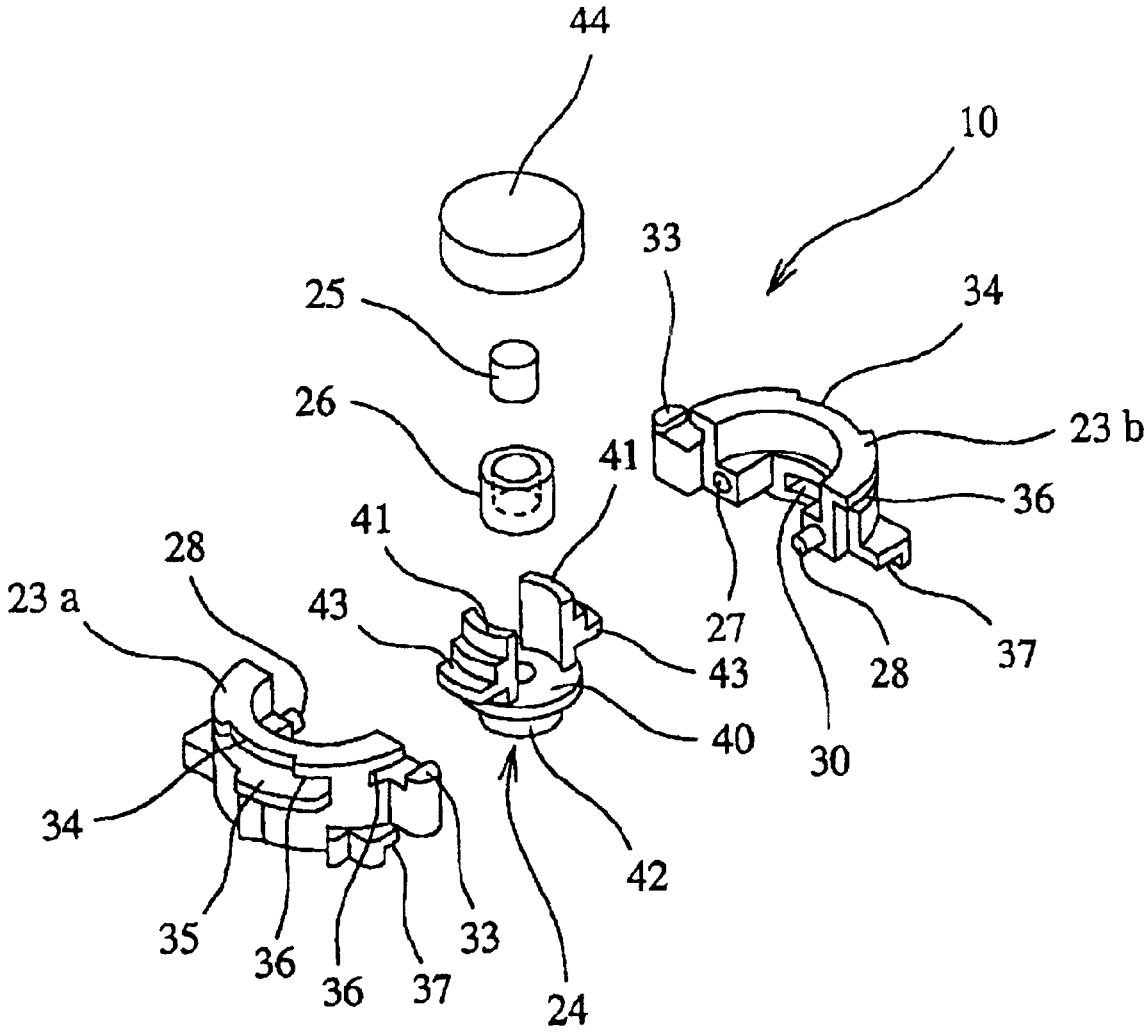
FIG. 5 is an exploded perspective view showing the structure of an attachment base.

The attachment base 10, as shown in FIG. 5, is constituted by a frame 23 which can be divided into right and left divided frames 23*a*, 23*b* and a support 24 supported by this frame 23.

The divided frames 23*a*, 23*b* have a fitting recessed portion 27 and a fitting convex portion 28 formed, respectively on a joining surface. The fitting convex portion 28 is joined and fit to the fitting recessed portion 27, so that the frame 23 is formed. Further, engaging holes 30 engaging with engaging plates 43 which are protruded from both sides of the support 24 are formed on the inner peripheral surfaces of the divided frames 23*a*, 23*b*, respectively. The attachment base 10 is constituted by joining the divided frames 23*a*, 23*b* together wherein their engaging holes 30 are engaged with the engaging plates 43.

The divided frames 23*a*, 23*b* have protruding portions 33 formed continuously on the joining surface thereof, and an inserting groove 37 in which the fastener 17 is inserted is formed in the lower portion of the protruding portion 33. Notch portions 34, 34 are formed orthogonal to the protruding portions 33, 33. A support piece 35 which is a linkage portion linked with a spin imparting mechanism A of the shooter 2 to be described later is formed in the lower portion of the notch portion 34. Attachment grooves 36 are formed in a clockwise direction of the peripheral surfaces of the notch portions 34 so as to extend to the other protruding portion 33.

The support 24 is provided with a circular arc shaped nipping plates 41 on the upper surface of a disc shaped base plate 40, and a fitting protruding portion 42 to fit with the fitting recessed portion 21 formed in the center of the base member main body 9 is protrusively formed on the lower surface of the disc shaped base plate 40. The engaging plate 43 engaged with the engaging hole 30 of the frame 23 is protrusively formed on the outside surface of the nipping plate 41, and a closed-end cylindrical container 26 which accommodates a magnet 25 as change means is nipped by the nipping plates 41, 41 and then covered by a lid 44. The magnet 25 may be formed in a size of the container 26 so as to be directly supported by the support 24.

When the engaging plates 43 of the support 24 are engaged with the engaging holes 30 of the divided frames 23*a*, 23*b* and the fitting convex portions 28 are fitted in the fitting recessed portions 27, the divided frame 23*a* and the divided frame 23*b* are joined together so that the attachment base 10 can be constituted.

This attachment base 10 permits the protruding portion 33 of the attachment base 10 to engage with a recessed groove 20 of the base member main body 9, and at the same time, permits the fitting protruding portions 41 of the lower portion of the attachment base 10 to fit in the fitting recessed portion 21 of the base member main body 9. Further, the fastener 17 is inserted through the opening portion 15 of the base member main body 9 and thrust into a thrust groove 37 of the attachment base 10, and a top end of the leg piece 16 of the fastener 17 is thrust on the base plate 40 of the support 24 so that the attachment base 10 is fixed on the base member main body 9, thereby constituting the base member 5 as shown in FIG. 2.

The deadweight member 6, as shown in FIG. 3, is formed in a disc shaped plate or polygonal shape with the center opened, and has a pair of overhang portions 50 protruding to the inner portion of the deadweight member 6 in opposition to each other on the inner peripheral portion of the deadweight member 6. Each of the overhang portion 50 is formed, in the center thereof, with an engaging groove 51 which engages with the protruding portion 33 of the attachment base 10. The deadweight member 6 may be formed of any material having a heavier weight than other materials, and usually it is preferably formed of metal.

As shown in FIG. 3, the attack ring 7 is a disc shaped member with its center opened circularly, and a pair of overhang pieces 52 is formed in opposition to each other on the inside of the opening, the inner peripheral portion of each overhang piece 52 having a circular arc shape and a size to fit to the attachment base 10 of the base member 5. An engaging piece 53 is protrusively formed in the center of the inner peripheral portion of each of the overhang pieces 52. The distance between the two engaging pieces 53 is set in such a manner as to be substantially equal to the distance between the notch portions 34 of the attachment base 10. Note that a plurality of attacking wings 54 to attack other toy tops are formed on the peripheral surface of the attack ring 7, and an engaging portion 56 to engage with engaging pieces 55*a* which are protrusively formed in both side portions of a chip 55 pasted with a seal (not shown) painted with famous characters or symbols is formed on the upper surface of the attack ring 7.

Next, in order to assemble the members structured as explained above, first, the deadweight member 6 is put on the base member 5 and the protruding portion 33 of the attachment base 10 and the engaging groove 51 of the overhang portion 50 of he deadweight member 6 are engaged. The attack ring 7 is put on the deadweight member 6, and the engaging piece 53 of the attack ring 7 and the notch portion 34 of the attachment base 10 of the base member 5 are positioned so as to conform to each other, and the attack ring 7 is pressed downward. In this way, the overhang piece 52 of the attack ring 7 abuts against the support piece 35 of the attachment base 10, and the engaging piece 53 faces the attachment groove 36. Then, the attack ring 7 is rotated clockwise and the engaging piece 53 is permitted to slide along the attachment groove 36 of the base member 5 up to the end portion thereof and the attack ring 7 is assembled into the base member 5. According to the foregoing procedure, the toy top having the deadweight member 6 and the attack ring 7 mounted on the base member 5 can be constituted.

Figure 6A:
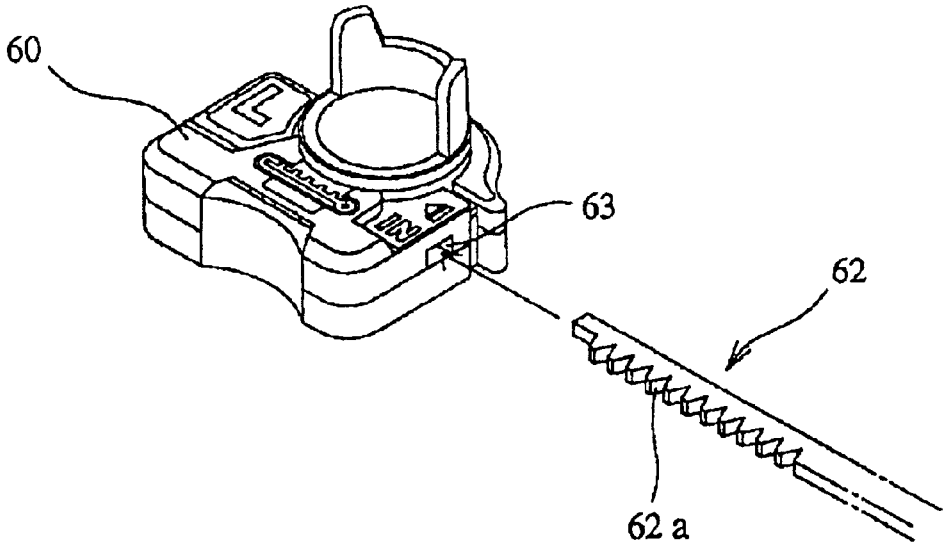
FIGS. 6A, 6B, and 6C are a perspective view, a front view and a bottom view of a shooter main body, respectively.
Figure 6B:
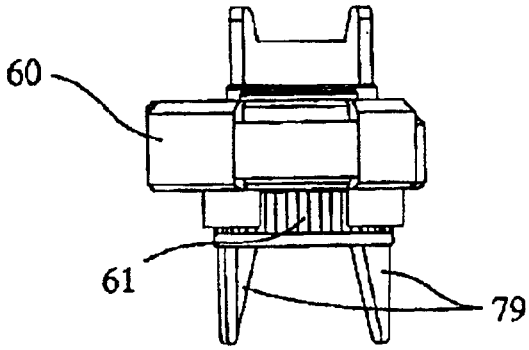
Figure 6C:
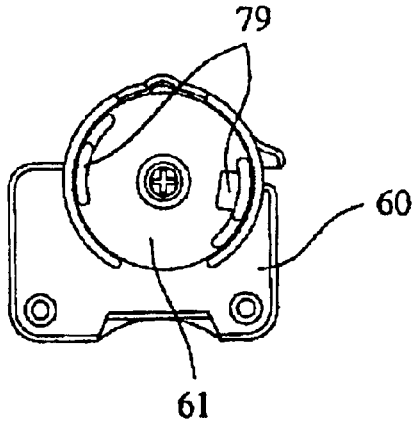

The shooter 2 is constituted by a shooter main body 60 and a rack belt 62, which permits a rotating body 61 rotatably attached to the base portion of the shooter main body 60 to spin (see FIGS. 6A to 6C). The shooter main body 60 is a hollow box, and on both side surfaces thereof, inserting hole 63 in which the rack belt 62 is inserted is formed. In the interior thereof, the spin imparting mechanism A to impart a torque to the toy top 1 and the locking mechanism B to lock this spin imparting mechanism A are arranged.

Figure 7A:
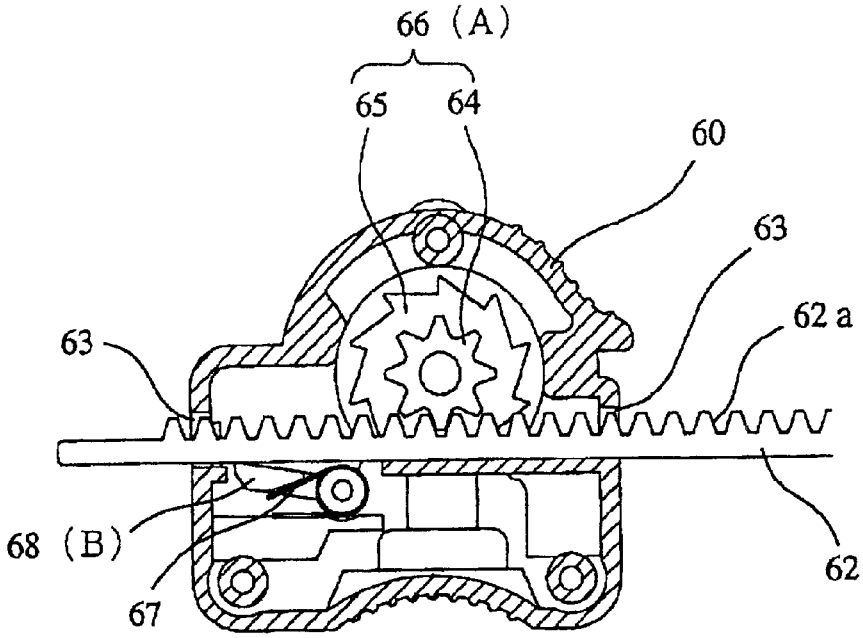
FIGS. 7A and 7B are essential sectional views showing an inner structure of the shooter main body.
Figure 7B:
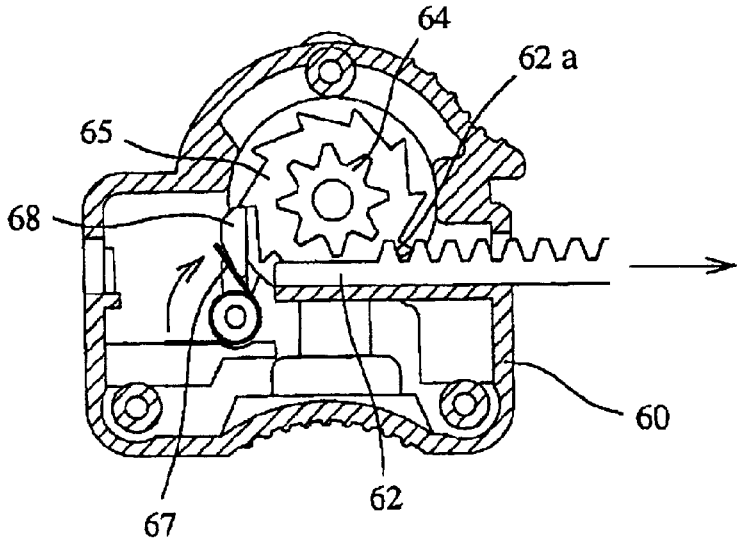

The spin imparting mechanism A is constituted by a driving shaft 66 which comprises a pinion gear 64 engaged with a rack gear 62*a* of the rack belt 62 and a ratchet gear 65 integrally formed on the same shaft with the pinion gear 64, and the locking mechanism B is constituted by a ratchet claw 68 energized so as to be engaged with the ratchet gear 65 at all times by a spring 67.

when the rack belt 62 is inserted, this ratchet claw 68 is pushed down in opposition to the spring 67 and disengaged from the ratchet gear 65, and at the time of pulling out operation of the rack belt 62, the pinion gear 64 is rotated. When the rack belt is pulled out until the rack belt 62*a* and the pinion gear 64 are disengaged from each other, pressing pressure of the ratchet claw 68 is released so that the ratchet claw 68 is energized by the spring 67 to rise up and be engaged with the ratchet gear 65 (the driving shaft 66) to immediately lock the rotation of the ratchet gear 65 (see FIGS. 7A and 7B).

Figure 8:
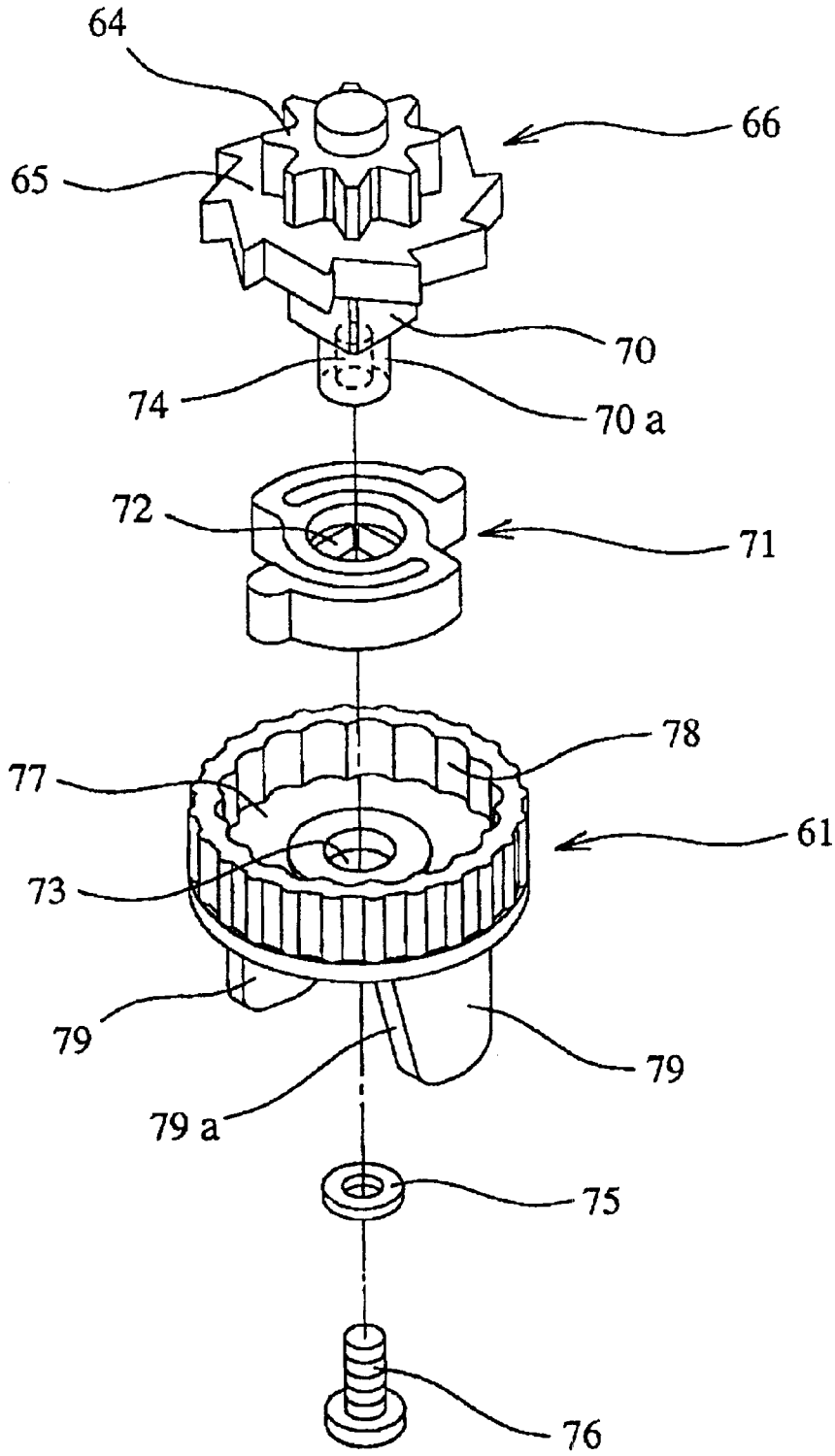
FIG. 8 is an exploded perspective view showing a structure of a spin imparting mechanism.

As shown in FIG. 8, a shaft body 70 is formed in the lower portion of this driving shaft 66, and this shaft body 70 is protruded downward from the base of the shooter main body 60. This shaft body 70 is a square shaft with a top end portion 70*a* thereof being formed in a cylindrical shape, and the square shaft portion fits into an angle hole 72 formed in the center of an S letter shaped stabilizer 71, the stabilizer 71 and the driving shaft 66 integrally rotating.

The top end portion 70*a* of the shaft body 70 is inserted into a shaft hole 73 which is formed in the center of the rotating body 61, and a screw 76 is screwed into a screw hole 74 formed in the top end portion 70*a* via a washer 75 so that the rotating body 61 is attached to the shaft body 70 so as to freely rotate.

This rotating body 61 has a circular engaging recessed portion 77 formed on the upper surface thereof, and a waveform engaging groove 78 which engages with the stabilizer 71 is provided on the inner peripheral surface of this engaging recessed portion 77, and two engaging plates 79 which engage with the toy top 1 being formed by being protruded downward (see FIGS. 6B and 6C).

Figure 9A:
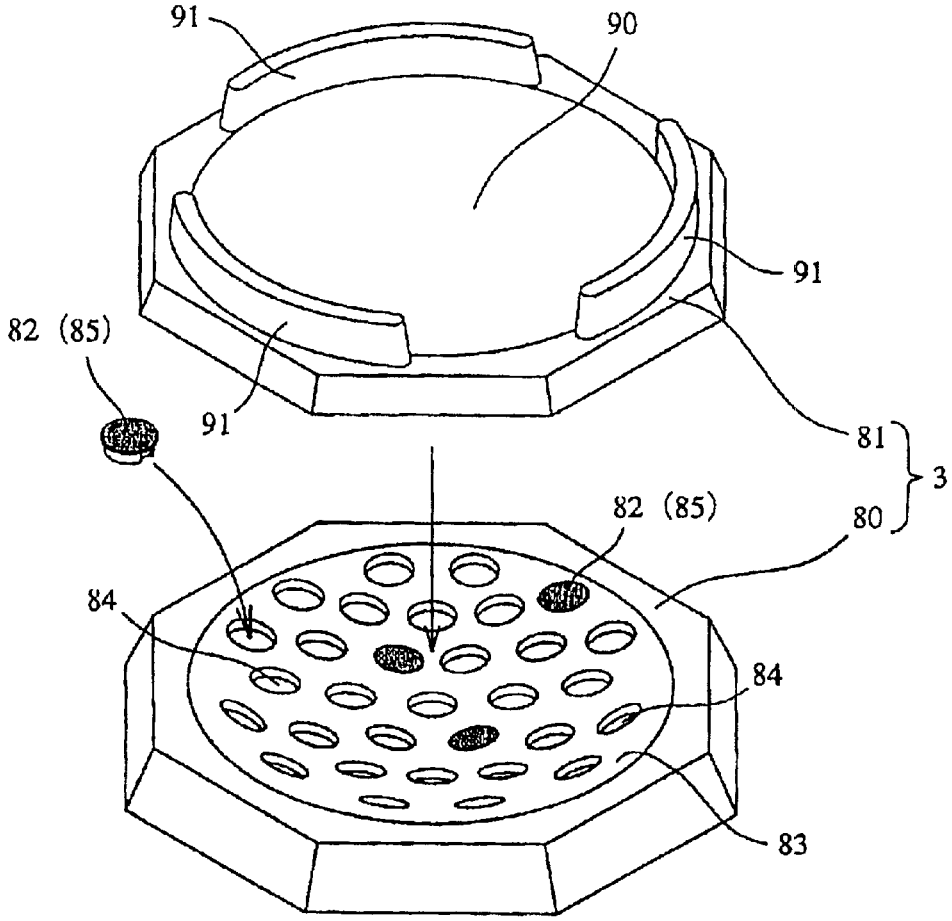
FIGS. 9A and 9B are perspective views showing a structure of a game board.
Figure 9B:
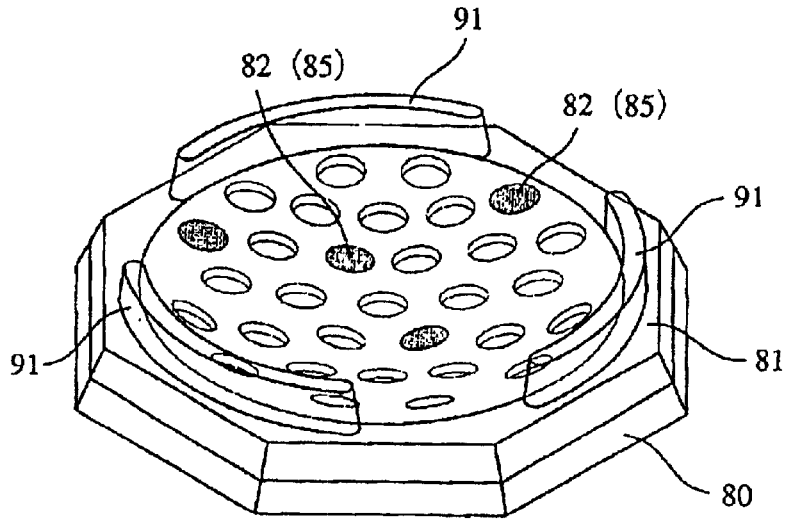

As shown in FIG. 9A, the game board 3 is constituted by a base board 80 which is formed in a trapezoid shape of raw material of non-magnetic substance such as plastic and a game board 81 which is stacked on this base board 80 so as to cover the same. The game surface which is the upper surface of the game board 81 is formed in a concave surface shape, and is formed to have a size enough to permit a plurality of toy tops 1 to spin simultaneously.

The base board 80 can be provided with a magnet 82 as a change means to act on the magnet 25, this magnet 25 is a change means being provided in the toy top to impart a change to the operational mode of the toy top. An upper surface 83 of the base board 80 is formed in a concave shape and a large number of circular recessed portions 84 are formed on the upper surface 83 of the base board 80, a disc shaped magnet 82 can be fitted into this recessed portion 84. This magnet 82 is mounted on a magnet casing 85, and the magnet casing 85 can be fitted into the recessed portion 84 on the game surface 83.

Figure 10A:
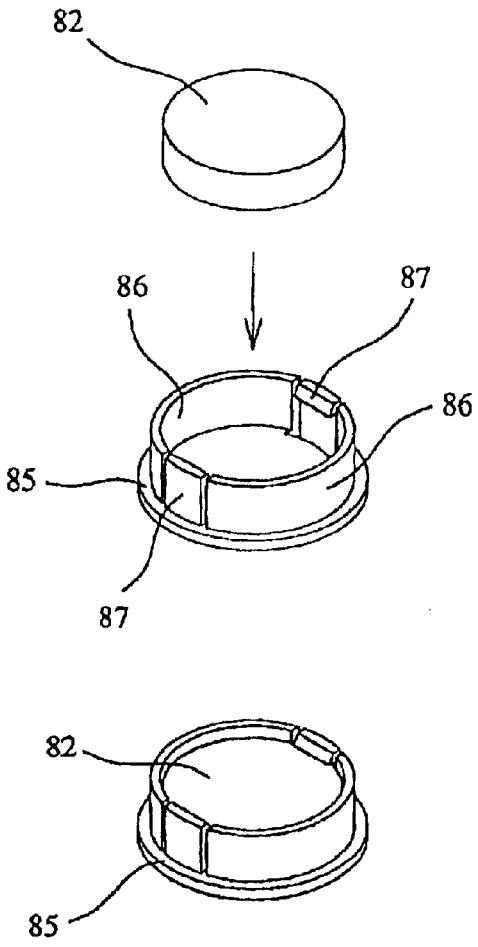
FIGS. 10A and 10B are bottom side perspective views showing a structure of magnets to be attached to the game board.
Figure 10B:
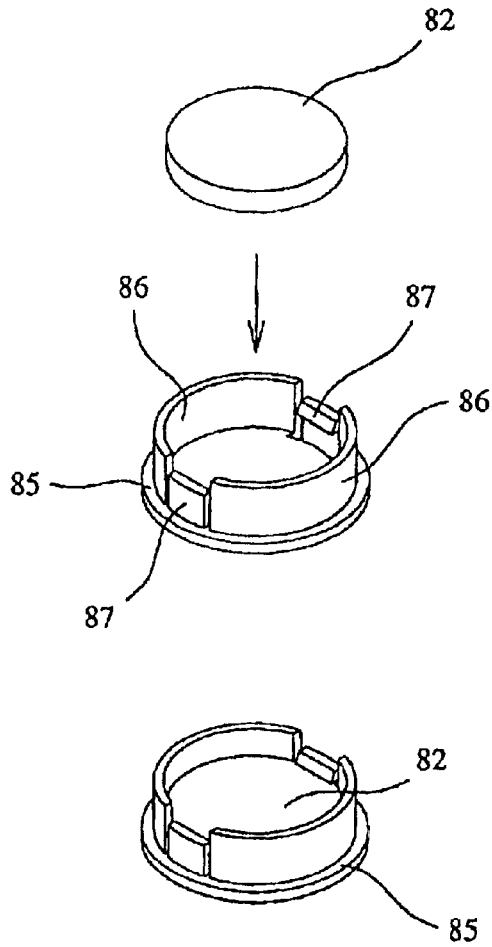

The magnet case 85 is formed with a low cylindrical shape, and a circumferential wall 86 is notched at opposing positions, and a pair of nipping pieces 87 being provided in each notched portion. This magnet casing 85 is available in two types: one for a thick magnet 82 having a strong magnetic force as shown in FIG. 10A and another for a thin magnet 82 having a weak magnetic force as shown in FIG. 10B. The magnet casing 85 mounted with the magnet 82 having a strong magnetic force comprises the nipping pieces 87 which are long and the magnet casing 85 mounted with the magnet 82 having a weak magnetic force comprises the nipping pieces 87 which are short.

A game surface 90 of the game board 81 which is stacked on the base board 80 is formed with the same rate of curvature as that of the upper surface of the base board 80, and the back of the game surface 90 is closely mounted on the upper surface of the base board 80. Further, a plurality of wall surfaces 91 are protrusively formed on the outside of the game surface 90. This wall surface 91 functions as a protective relief wall that returns toy tops 1, which strike against one another and are driven out of the game board, to the game surface 90.

This game board 81 is formed of transparent resin so that a position of the arranged magnet 82 can be seen by a player. However, it may be formed of opaque resin so that the position of the arranged magnet 82 cannot be seen by a player.

Note that in this embodiment the base board 80 has the recessed portion 84 formed therein to which the magnet 82 is attached. However, the game board 81 may be formed so that the magnet 82 may be pasted on the back thereof by adequate means such as double-coated tape and the like.

Next, the usage mode of the toy top 1 as constituted above will be described.

Figure 11A:
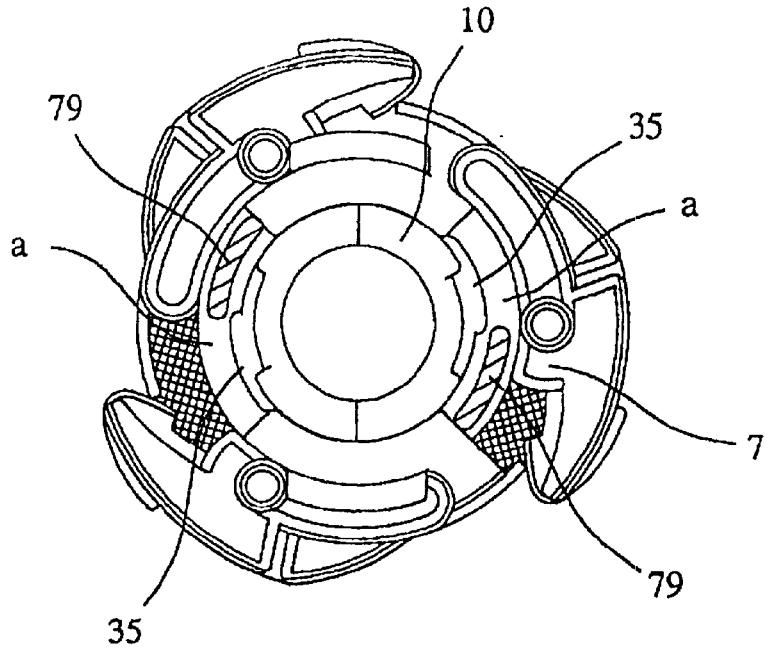
FIGS. 11A and 11B are fragmentary plane views showing the relation between the toy top and the shooter.
Figure 11B:
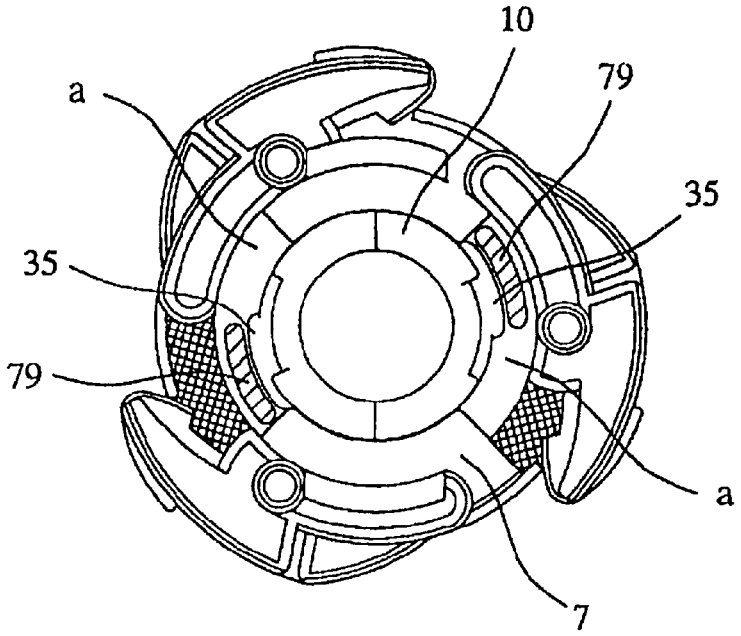

First, in order to spin the toy top, the toy top 1 is set on the shooter main body 60. At this time, as shown in FIG. 11A in which the engaging plates 79 are cut away, the top end of the engaging plate 79 formed on the rotating body 61 of the shooter main body 60 is inserted into a space "a" formed between the attack ring 7 and the attachment base 10 of the toy top 1, and as shown in FIG. 11B, the rotating body 61 is rotated counter-clockwise so that the engaging plate 79 of the rotating body 61 engages with the support piece 35 of the attachment base 10. At this time, the engaging plate 79 is positioned in the top end side of the space "a" and a space is formed in the rear end side of the space "a".

In this state, the rack belt 62 is inserted sufficiently into the inserting hole 63 of the shooter main body 60. In the state in which the rack belt 62 being inserted, the ratchet claw 68, which is a locking mechanism, is pushed down by the rack belt 62 so that a locking state of the ratchet gear 65 is released. Next, when the rack belt 62 is operated to be pulled out with vigor, the pinion gear 64 engaged with the rack gear 62*a* is vigorously rotated and the rotating body 61 integrated with this pinion gear 64 is rotated, so that the toy top is also vigorously spun by being linked with the rotation of the rotating body 61. When the rack belt 62 is pulled out, the rack gear 62*a* and the pinion gear 64 are disengaged from each other, and at the same time pressing pressure of the ratchet claw 68 by the rack belt 62 is immediately released so that, by being energized by the spring 67, the ratchet claw 68 rises up (see FIG. 7B) to lock the ratchet gear 65, thereby stopping rotation of the rotating body 61 immediately.

Even when the rotation of the rotating body 61 stops, the toy top 1 spins by inertia and spins counter-clockwise against the engaging plate 79, and therefore, the engaging plate 79 relatively moves toward the rear end side of the space "a" and thus the engagement between the engaging plate 79 and the support piece 35 of the attachment base 10 is released. At the same time, since the rear edge of the engaging plate 79 is formed obliquely, the toy top spins vigorously to separate from the shooter main body 60 and drops on the game board 3 and spins on the game board 3.

Figure 12A:
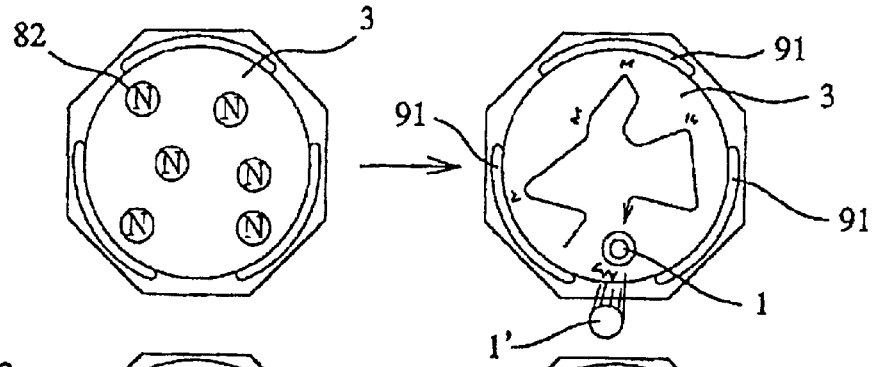
FIGS. 12A to 12E are plane views of the game boards showing operational modes of the toy top using change means.
Figure 12B:
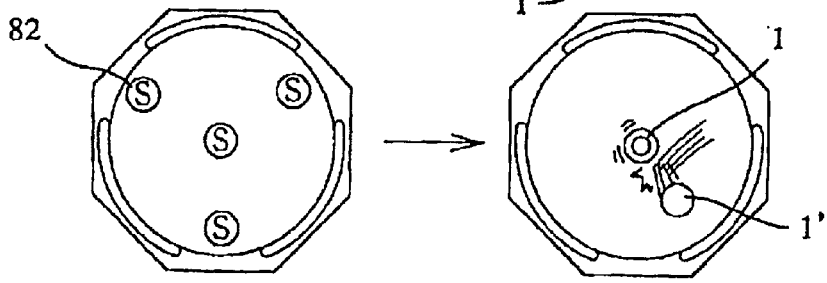
Figure 12C:
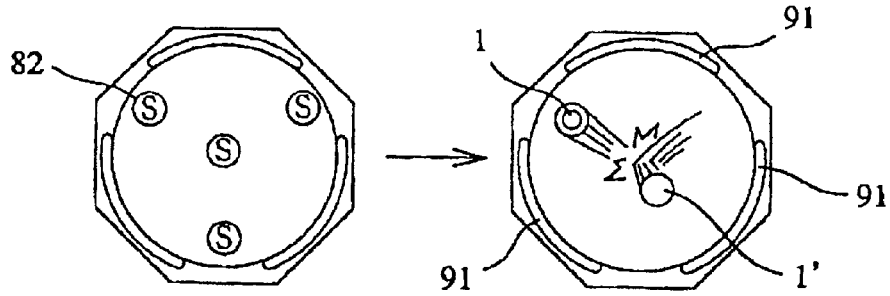

The toy top 1 which spins on the game board 3 changes its operational state due to the relationship between the magnet 25 in the toy top 1 and the magnet 82 arranged on the game board 3. For example, when the toy top 1, in which the lower part of the magnet 25 is set so as to have N polarity, is spun on the game board 3, as shown in FIG. 12A, with the upper surface of the magnet 82 having N polarity on the game board 3, the toy top 1 moves like a flash of lightening so that it can smash against the toy top 1' of the competitor. When the magnet 82 is arranged to have S polarity on the upper surface, as shown in FIG. 12B, the toy top 1 can continuously spin in a steady state without being driven out by the toy top 1' of the competitor even when hit by the same. Further, as shown in FIG. 12C, in the case where the magnet having S polarity is arranged in the portion where there is no protective wall, even when the toy top 1 is driven out by the toy top 1' of the competitor toward the portion where there is no protective wall, it is attracted by the magnet and its repelling force is weakened, and thereby it is not driven out of the game surface.

Figure 12D:
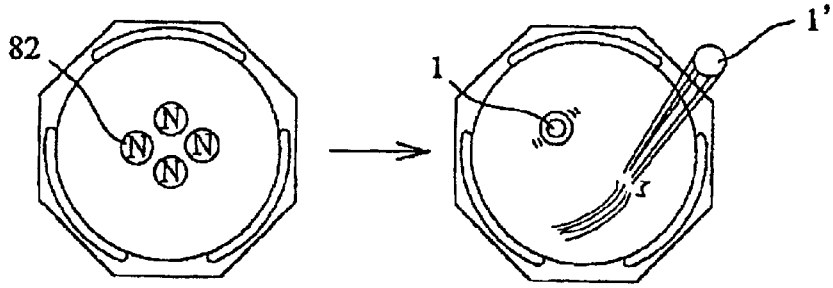
Figure 12E:
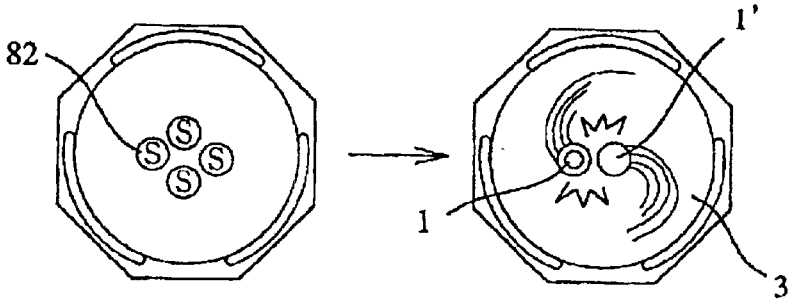

As shown in FIG. 12D, by focusing the magnets having N polarity to the center of the game surface, the spinning position of the toy top 1 can be made much more steady. When the toy top 1 smashes against the toy top 1' of the competitor, though it drives out the toy top 1' of the competitor, it is not driven out by the toy top 1' of the competitor. As shown in FIG. 12E, by focusing the magnets having S polarity to the center of the game surface, the toy top 1 can be quickly moved to the center of the game surface on the recessed surface and quickly brought into contact with the toy top 1' of the competitor, so that outcome of the game can be quickly decided.

As described above, when the magnet 82 is arranged on the game board 3, by selecting the arrangement position of the magnet 82 and the polarity of the magnet 82, the toy top can be permitted to have a variety of operational modes so as to increase the pleasure of playing the game. It is not necessary to set all the magnets 82 to have the same polarity. The operational modes of the toy top can be made even more rich in variety, and the pleasure of playing the toy top game can be further increased by setting the magnets on the game board so that S polarity and N polarity coexist.

Figure 13:
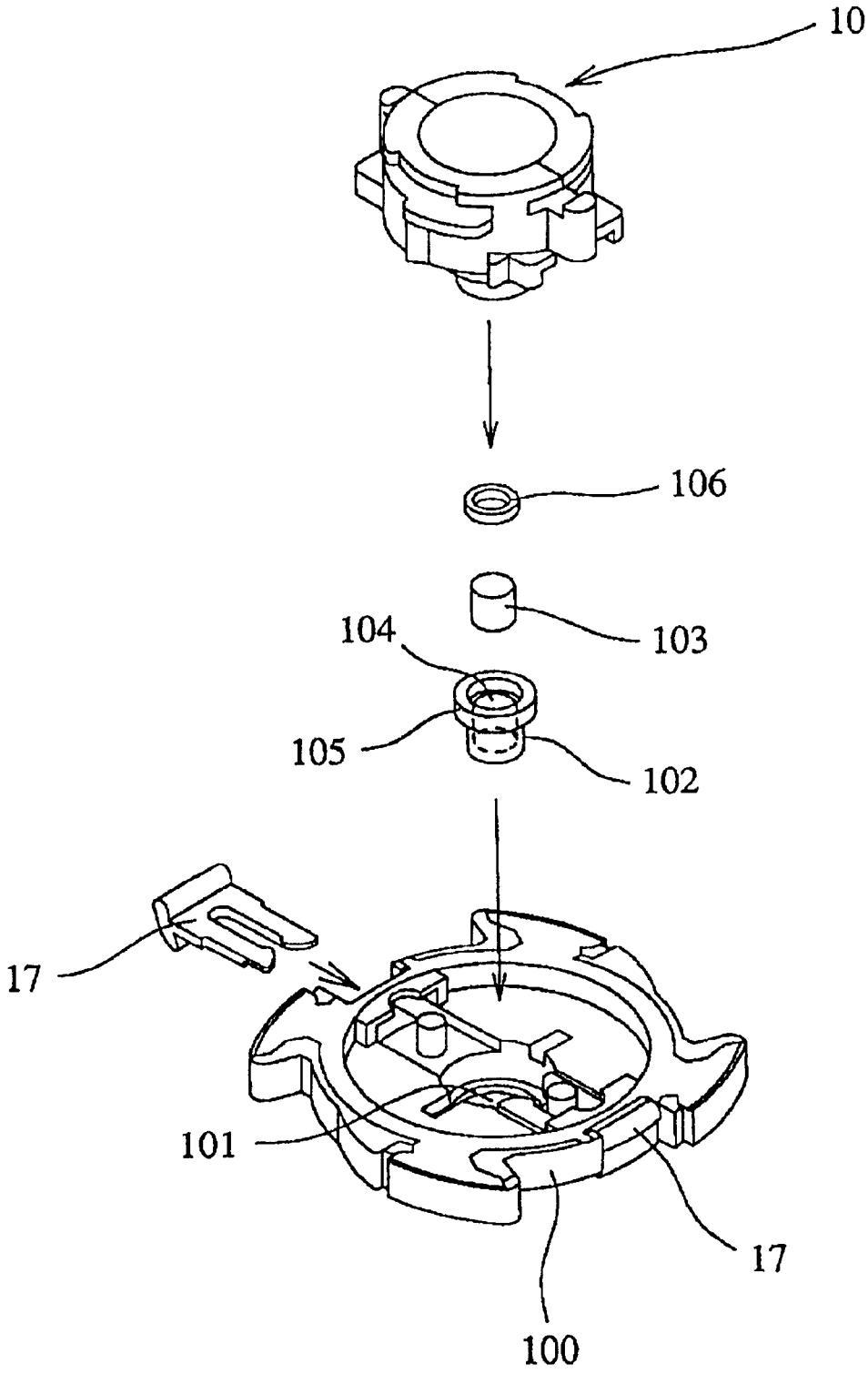
FIG. 13 is an exploded perspective view showing a base member in another embodiment.

Next, the toy top provided with the magnet, which is change means, in the shaft body will be described. As shown in FIG. 13, this toy top has a circular opening portion 101 formed on the base of a base member main body 100, and a shaft body 102 can be protruded from this opening portion 101. This shaft body 102 is made of a transparent ABS resin and has a housing recessed portion 104 to house a magnet 103, which is a change means, formed on the upper surface. A deadweight portion 105 is formed the circumferential edge of the top of the shaft body 102, and by inserting the shaft body 102 into the opening portion 101 from the inner side of the base member main body 100, the shaft body 102 can be attached to the base member main body 100.

Figure 14:
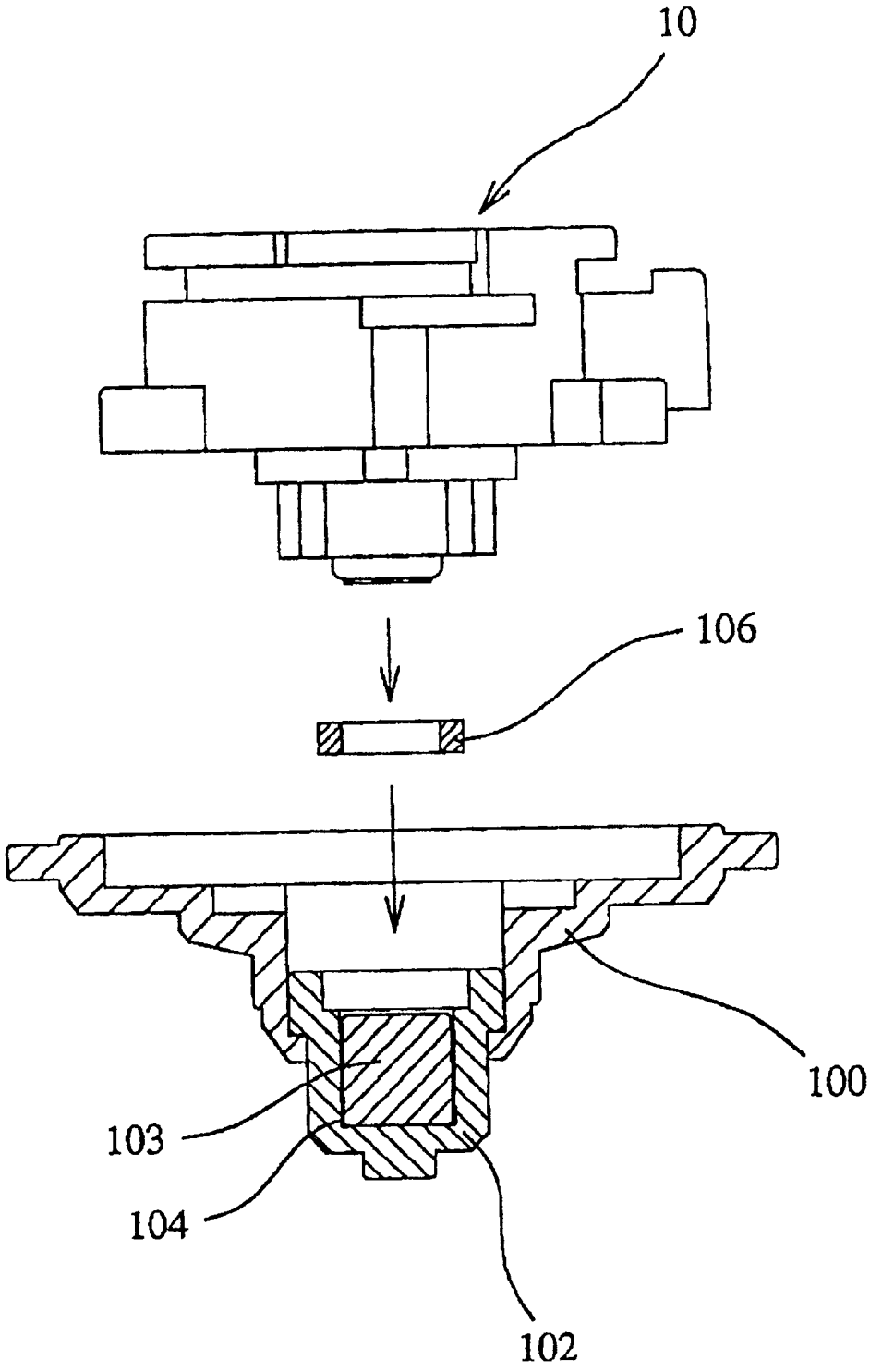
FIG. 14 is a longitudinal sectional view showing the base member of the embodiment shown in FIG. 13.
Figure 15:
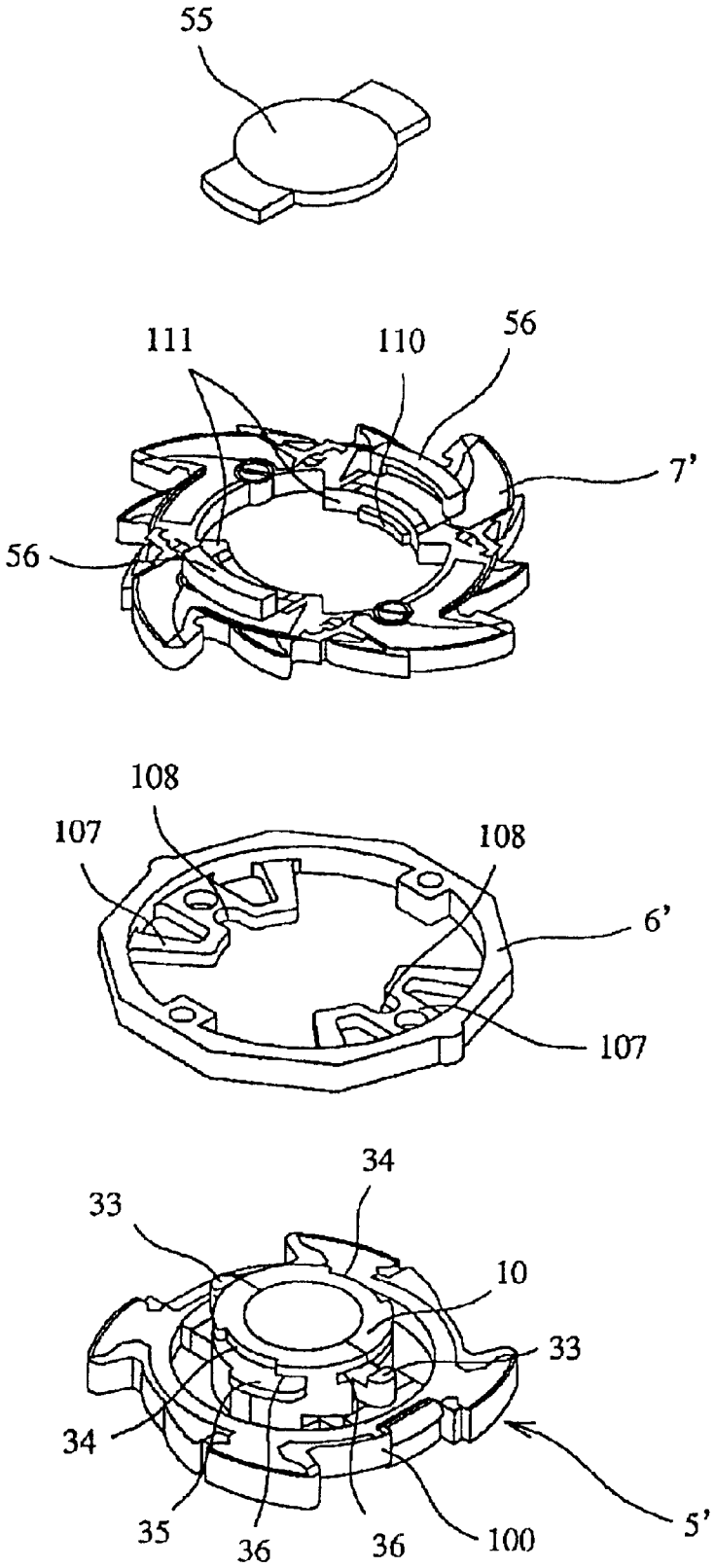
FIG. 15 is an exploded perspective view showing an assembly of the toy top having the base member of the embodiment shown in FIG. 13.

Assembling of the toy top may be executed in such a manner that the shaft body 102 is inserted into the opening portion 101 from the inner side of the base member main body 100, and after the top end of the shaft body 102 is protruded from the base of the base member main body 100, the magnet 103 is housed in the housing recessed portion 104 and a fixing ring 106 is placed on the magnet 103, and similarly to the toy top 1, the attachment base 10 is fixed by the fastener 17 to constitute a base member 5' (see FIGS. 14 and 15).

Figure 16:
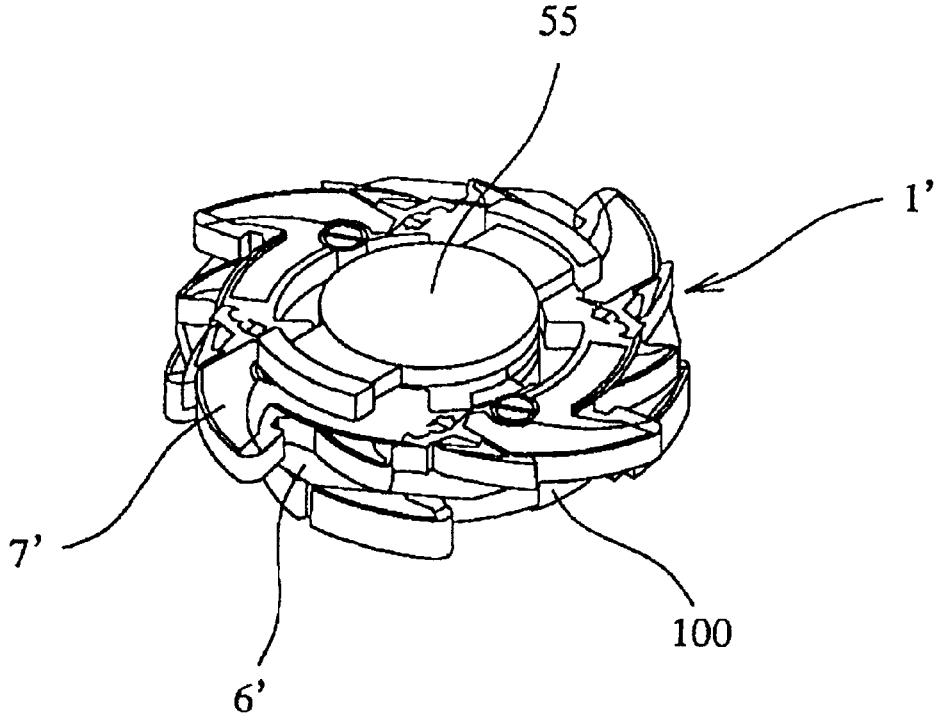
FIG. 16 is a perspective view of the toy top having the base member of the embodiment shown in FIG. 13.

The base member 5' (as shown in FIG. 15) constituted in this way has, similarly to the toy top 1, a deadweight member 6' stacked thereon, the protruded portion 33 of the attachment base 10 and the engaging groove 108 of the overhang portion 107 of the deadweight member 6' are brought into engagement, an attack ring 7' is stacked on the deadweight member 6', an engaging piece 110 of the attack ring 7' and the notch portion 34 of the attachment base 10 are positioned so as to conform to each other and the attack ring 7' is pressed downward. In this way, an overhang piece 111 of the attack ring 7' abuts against the support piece 35 of the attachment base 10, and the engaging piece 110 faces the attachment groove 36. Then, the attack ring 7' is rotated clockwise so that the engaging piece 110 is permitted to slide along the attachment groove 36 of the attachment base 10 to the end portion thereof, thereby assembling the attack ring 7' into a base member 10' (see FIG. 15). According to the above described procedure, the toy top 1' having the deadweight member 6' and the attack ring 7' stacked on the base member 5' can be constituted (see FIG. 16).

According to the toy top using the base member 5' constituted as explained above, since the distance between the magnet 82 and the magnet 103 arranged on the game board 3 is close, the toy top is repelled or attracted by a strong force, and the movement of the toy top on the game board 3 becomes dynamic, thereby frequently causing the toy tops to smash into each other, to make the toy top game even more exciting.

According to the first aspect of the invention, the change means is provided for changing the operational modes of the toy top, without the spinning toy top being influenced by the player directly or indirectly. Hence, the toy top makes unexpected movements and thus the pleasure of playing the game is increased. By turning the change means into magnets, the magnet provided on the toy top and the magnet provided on the game board repel or attract each other. Therefore, when the magnets repel each other, the moving speed of the toy top is accelerated so that it can smash against the toy tops of the other competitors or avoid the attacks of the toy tops of the competitors. When the magnets are attracted to each other, even if the toy top is driven out by the toy tops of the other competitors, the brake is applied so that a force to inhibit the flying out of the toy top from the game board is imposed, thereby allowing the toy top to continue competing against the toy tops of the other competitors.

According to the second aspect of the invention, any fitting recessed portion can be selected from among the fitting recessed portions formed in the game board and the magnets can be arranged therein so that the operational modes of the toy top can be set to a variety of forms. Furthermore, when the game board is made opaque, the location of the magnet cannot be seen and, therefore, the movement of the toy top becomes mysterious, which can enhance interest in the toy top game much more.

According to the third aspect of the invention, the toy top can be spun only by the pulling out operation of the rack belt which is inserted into the shooter and therefore no difficult operation for spinning the toy top is required. Thus the toy top game can be enjoyed even by young people.

(Description of Reference Numeral)

1 toy top
2 shooter
3 game board
25 change means (magnet)
62 rack belt
80 game board
81 base board
82 change means (magnet)
103 change means (magnet)
A spin imparting mechanism
B locking mechanism

What is claimed is:

1. A toy top game unit comprising:

a toy top, driving means for rotating said toy top, including a spin imparting means to impart a spinning force to the toy top, a locking means to lock the spin imparting means and a rack belt, the spin imparting means is operated by linking it with a pulling-out operation of said rack belt inserted into the driving means, and when the rack belt is pulled out from the driving means, the locking means starts and the spin imparting means immediately stops, and the toy top is provided with a linking portion to link the toy top with the spin imparting means, and the toy top, which spins by linking it with the operation of the spin imparting means, spins by inertia after the stopping of the spin imparting means and a linkage with the spin imparting means is disengaged;

a game board for receiving said toy top thereon, and means for interacting the toy top and the game board, and for imparting a change to an operational mode of the toy top on said game board, said interacting means including first magnet means arranged on the toy top and second magnet means arranged on the game board.

2. The game unit according to claim 1, wherein the game board comprises a base board having an upper surface thereof and a game board mounted on the upper surface of the base board, said upper surface of said base board being provided with a receiving means for receiving said second magnet means therein, said game board being detachably mounted on said upper surface of said base board.

3. The game board according to claim 2, wherein at least a portion of said game board covering said upper surface of said base board is made transparent.

* * * * *